US010053855B2

(12) United States Patent
Yonkers et al.

(10) Patent No.: US 10,053,855 B2
(45) Date of Patent: Aug. 21, 2018

(54) CLUSTER CAP SEALING MECHANISM AND METHOD

(71) Applicants: E. Hubbard Yonkers, Hopkinton, NH (US); Gregory S. Baletsa, Andover, MA (US); Thomas E. Feldmar, Shrewsbury, MA (US)

(72) Inventors: E. Hubbard Yonkers, Hopkinton, NH (US); Gregory S. Baletsa, Andover, MA (US); Thomas E. Feldmar, Shrewsbury, MA (US)

(73) Assignee: L-3 Communications Essco, Ayen, MA (US)

( * ) Notice: Subject to any disclaimer, the term of this patent is extended or adjusted under 35 U.S.C. 154(b) by 797 days.

(21) Appl. No.: 14/120,923

(22) Filed: Jul. 9, 2014

(65) Prior Publication Data

US 2016/0010322 A1 Jan. 14, 2016

(51) Int. Cl.

| | |
|---|---|
| ***E04B 1/32*** | (2006.01) |
| ***B65D 65/38*** | (2006.01) |
| ***B65D 85/00*** | (2006.01) |

(52) U.S. Cl.

CPC ..... *E04B 1/3211* (2013.01); *B65D 65/38* (2013.01); *B65D 85/70* (2013.01); *E04B 2001/3247* (2013.01)

(58) Field of Classification Search

CPC ..... E04B 1/3211; E04B 2001/3247; B65D 65/38; B65D 85/70

See application file for complete search history.

(56) References Cited

U.S. PATENT DOCUMENTS 3,323,820 A * 6/1967 Braccini ..... E04B 7/105 403/218
4,365,818 A * 12/1982 Tolliver ..... F16L 17/025 277/609
5,607,167 A * 3/1997 Franckx ..... F16J 15/022 174/653

* cited by examiner

*Primary Examiner* — Kevin R Kruer
(74) *Attorney, Agent, or Firm* — Weiss & Weiss; Philip M. Weiss

(57) ABSTRACT

A cluster cap sealing mechanism and method for a Geodesic construction. A packaging for a sealant placed in a ring wherein the ring is a sealant delivery device for providing a predetermined volume of sealant to the joints of the Geodesic construction.

9 Claims, 9 Drawing Sheets

CLUSTER CAP SEALING MECHANISM AND METHOD

FIELD OF THE INVENTION

The present invention relates to a cluster cap sealing mechanism and method.

BACKGROUND OF THE INVENTION

U.S. Pat. No. 5,040,803 relates to a cavity sealing arrangement and method. A vehicle body pillar has a cavity therein through which air flow creating undesirable noise and in which moisture and fluids such as water are not to be collected. An expandable sealant plug is inserted therein and retained in place. The sealant material forming the plug is later expandable under controlled conditions. Preferably during the electro-coated coated paint baking and curing operation, the sealant is exposed to appropriate temperatures for sufficient time to expand the sealant about 800% and cure it, sealing the cavity so as to prevent the flow of air through it. The expanded sealant also effectively blocks the intrusion of fluids such as water, minimizing corrosion within the pillar.

U.S. Pat. No. 6,519,784 relates to a water closet seal apparatus. The seal apparatus is a seal between a commode and a drain pipe comprising a pipe extension, a gasket, and a flanged base. The pipe extension comprises an extension sealing surface. The gasket comprises a sealing lip, a pipe extension clearance, and a gasket sealing surface. The flanged base comprises a pipe bonding surface and a base sealing surface.

U.S. Pat. No. 6,735,912 relates to a method and apparatus for sealing the joints, using a unified protective joint cap, of jointed building panel systems having a plurality of building panels. The unified sealing member is applied on top of the jointing means of the panel system where no modifications or alterations of the jointing means is required. The protective joint cap may be applied directly to a jointing system in need of repair without the requirement of resealing the jointing system. The protective cap does not require an anchoring means to be installed prior to application. The protective joint cap preferably contains an incorporated extrusion suitable for maintaining a bead of liquefied elastomeric sealant, which may be applied prior to the sealing member's installation.

U.S. Pat. No. 7,232,953 relates to an insulation cap of a wire joint of a joined electrical wire, the insulation cap including a cap main body for receiving the wire joint being formed by joining cores of a plurality of covered wires and an electro-conductive sleeve, and a flexible fastener provided on an inner wall of the cap main body for fastening the wire joint by contacting a rear end of the electro-conductive sleeve thereon. The flexible fastener is formed as an integral part of the cap main body by fastening a molding die through a hole provided by an opposite end of a joint insertion end of the cap main body. A plurality of flexible fasteners are provided axial symmetry to extend toward a direction of inserting the wire joint from a base formed as an integral part of the inner wall of the cap main body.

U.S. Pat. No. 7,534,047 relates to a bearing assembly having a roller bearing with an inner case fitted around the journal portion of an axle. An outer raceway combines with the inner raceway to receive roller elements. A backring ring is centered to the shaft fillet. An annular wear ring is positioned between the inner case and the backring ring. An annular sealant bead or a sealant ring form a seal between the shaft shoulder and the backring ring.

U.S. Pat. No. 8,388,293 relates to an insulated, sealed cap that overlies and protects a fastener component on a substrate in association with a substrate opening. The sealed cap includes an outer cap component filled partially with a selected sealant material and assembled with an inner collect sized and shaped to fit with a slip fit about the fastener component such as a nut at one side of a selected substrate. An inboard edge of the inner collect seats on and substantially seals with the substrate. The outer component is then displaced toward the substrate to extrude the sealant material into a thin and substantially uniform layer joined with an extruded outer bead on the substrate, and then permitted to cure. Tapered ribs on the inner collect effectively lock with the outer cap component during sealing material curing and subsequently.

U.S. Pat. No. 8,602,764 relates to a sealant mold for sealing a dome element particularly at a region about an interface with a substrate such as an aircraft fuel tank wall. The sealant mold is formed from a lightweight plastic material, and includes an outer cap portion having an opening formed therein, in combination with an integral outer skirt to define a gap or trough for receiving and supporting a metered quantity of a curable sealant material. The mold is slidably fitted onto a dome element with outer skirt displaced downwardly to extrude the sealant material about the lower region of the dome element. The sealant material is allowed to cure, after which the sealant mold can be stripped from the cured sealant material.

U.S. Pat. No. 8,616,868 relates to a sealant mold for sealing a domed nutplate unit at a lower region about an adhesively attached interface with a substrate such as an aircraft fuel tank wall. The sealant mold is formed from a lightweight plastic material, and includes an outer cap portion having an opening formed therein, in combination with an integral outer skirt to define a gap or trough for receiving and supporting a metered quantity of a curable sealant material. The mold is fitted onto a dome of the nutplate unit with an inner cap inboard edge landed onto a dome shoulder. The outer skirt is then displaced downwardly about the landed inner cap to extrude the sealant material about the lower region of the nutplate unit such as the adhesively attached interface with the substrate. The sealant material is allowed to cure, after which the sealant mold can be stripped from the cured sealant material.

A radome is a framed spherical structure which encloses and protects antenna equipment from the elements. The radome consists of triangular shaped panels. The panel frames are bolted together in a predetermined manner. All panel-to-panel bolt holes are accessible from the inside of the radome for insertion of the fastening hardware. The corner junctions of the panels are secured with inside and outside cluster caps. In the prior art, silicone sealant is applied at all outer joints to prevent the free ingress of water. A bead of sealant was applied around the outer edge of the cluster cap cover and the area between the cluster cap and radome membrane surface was filled with sealant.

Currently frame panels are assembled rail to rail. Silicone caulk is applied at the rail to rail joint. At the intersection of the corner apexes, an inner support plate (disc) is bolted in place connecting the corner bosses of the frame. The outer cap plate is positioned and bolted into place. Sealant is then applied to fill the gap between the underside of the disc and the membrane panels of the frame. The narrow departure angle of the membrane surfaces precludes positioning the sealant nozzle to assure contact of the sealant to the underside of the disc. Sealant is applied to the outer wall of the cap plate and a molded plastic cap is installed and dressed with a final fillet of sealant around its base. The attachment is not enduring and caps are blown off resulting in leakage at those joints.

Leak paths may be created during the application of sealant. Application is craft intensive, unwieldly, and expensive, with no means of verification as to effectiveness.

A caulking gun cannot go into all angles of the radome. The current problems with radomes is that water leaks inside a radome.

SUMMARY OF THE INVENTION

The present invention relates to a sealant delivery device placed between the outer structural disc and the upper surfaces of mating parts (frame rail tops and panel membranes). When bolts are fitted and tightened down, the delivery device is squeezed flat, extruding sealant load onto and into the features of the mating parts. By providing a predetermined volume of sealant, the device seals effectively by accommodating a range of intersecting panel to structural disc joint conditions characteristic of this type of aluminum structural frame and membrane closure of the Geodesic construction.

The present invention relates to a protective molded elastomer cap with integral snap-on and/or bayonet-type rotational fixation that attaches to the outer structural disc, to provide additional protection to the attachment bolts, and extends outward and down providing a conformal perimeter lip that bears on the flat membrane panels. The contours of the cap deflect wind and rain gusts. It is an object of the present invention for the cap in an additional embodiment to improve its performance by having a band of sealant adhesive at and inside the perimeter.

The present invention relates to a method and device for improving water sealing at the cluster cap of a radome. It is an object of the present invention for the method to reduce installation time and cost.

The present invention relates to a sealant delivery/transport device to secure inner features of the joint of the cluster cap from water ingress. The device of the present invention comprises an elastomer support ring providing upper and lower channels preloaded with high performance self-repairing conformal sealant. The combination of the ring and sealant channels enables mating to the varying heights and angles presented by the different panels that occur in dome construction.

The sealant of the present invention has promiscuous properties, therefore it is an object of the present invention to provide a packaging in the form of a siliconized release treated vacuum formed shell to receive and support the lower sealant cross section after being deposited in its channel. The upper channel, which mates to the inside (flat) surface of the cluster disc, is then filled and protected with a silicone release treated vacuum formed shell. It is an object of the present invention for the assembly to be further protected in a hermetically sealed multi-layer film pouch until it arrives at the assembly site.

The present invention relates to an outer rigid protective cap with a conformal elastomer lip to deflect wind and rain gusts. It is an object of the present invention for the cap to have an integral snap-on device. Further, because the cap fully encloses the array of bolt heads additional protection is provided by a multiple lip seal or soft O-ring in the cap but outside the bolts.

The present invention comprises a Geodesic dome having aluminum frame triangles, a membrane skin, and sealed joints. The present invention further comprises a cluster of corner bosses, having an outer cap and an inner cap. Aluminum frame beams, which create the aluminum frame triangles, are attached to the corner bosses. Beams of each triangular facet are bolted to the next facet. The inner cap and the outer cap are bolted to the cluster of corner bosses.

The cluster of corner bosses has a pre-dosed sealant ring that is attached. The cluster of corner bosses comprises an inner cap below it, the pre-dosed sealant ring above it, with the outer cap above it. A membrane which is between the aluminum frame beams is attached to an attachment groove. It is an object of the present invention for the membrane to be attached to the attachment groove through an epoxy bond. The groove is for the silicone sealant.

It is an object of the present invention for the sealant ring to have an upper sealant channel pre-loaded with sealant, and a lower sealant channel pre-loaded with sealant.

The present invention further relates to packaging for the sealant ring. It is an object of the present invention for the packaging to comprise an upper vacuum-formed protective plastic shell and a lower vacuum-formed protective plastic shell that is deployed above and below the sealant ring. It is an object of the present invention for the shell packaging to be hermetically sealed in an aluminum composite-film packaging pouch to provide extended shelf life.

It is an object of the present invention for the sealant ring to comprise a low durometer elastomer that collapses when the outer cap is installed, driving the pre-loaded sealant into the mating surfaces.

It is an object of the present invention for the sealant ring to flatten after pressure has been added, wherein the ring becomes embedded in the gasket, forcing the lower sealant band onto the membrane skin.

It is an object of the present of invention for the sealant ring to have pre-loaded sealant. The sealant ring comprises a top flap and bottom flap providing nearly complete closure. The sealant expulsion package provides a high level of protection.

The present invention relates to a method for expelling the sealant from support channels to opposite surfaces to be sealed. Force is exerted which causes the sealant to be forced from the support channels.

It is an object of the present invention for the outer cap to provide retaining lobes to mate with complementary features inside additional protective cap.

The present invention further comprises a molded elastomer cap having an insertion contour and retention pockets. The zone of the lip conforms to the flat facets of the membrane skin of the dome.

DETAILED DESCRIPTION OF THE INVENTION

Figure 1:
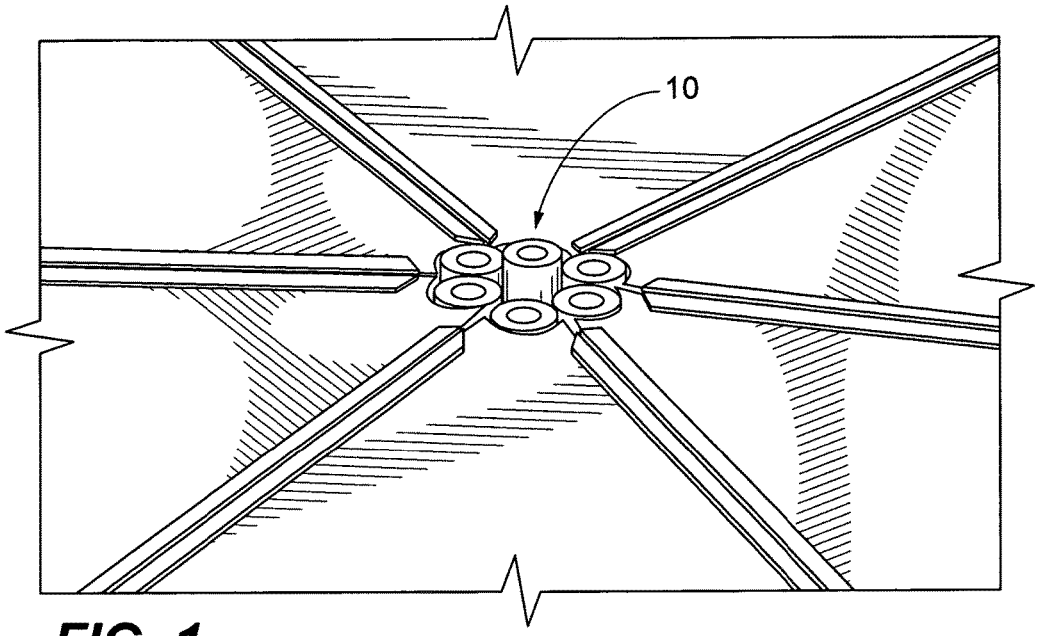
FIG. 1 shows a top view of a cluster joint pre-sealant and cap.

FIG. 1 shows a cluster joint 10 before sealant application and cap.

Figure 2:
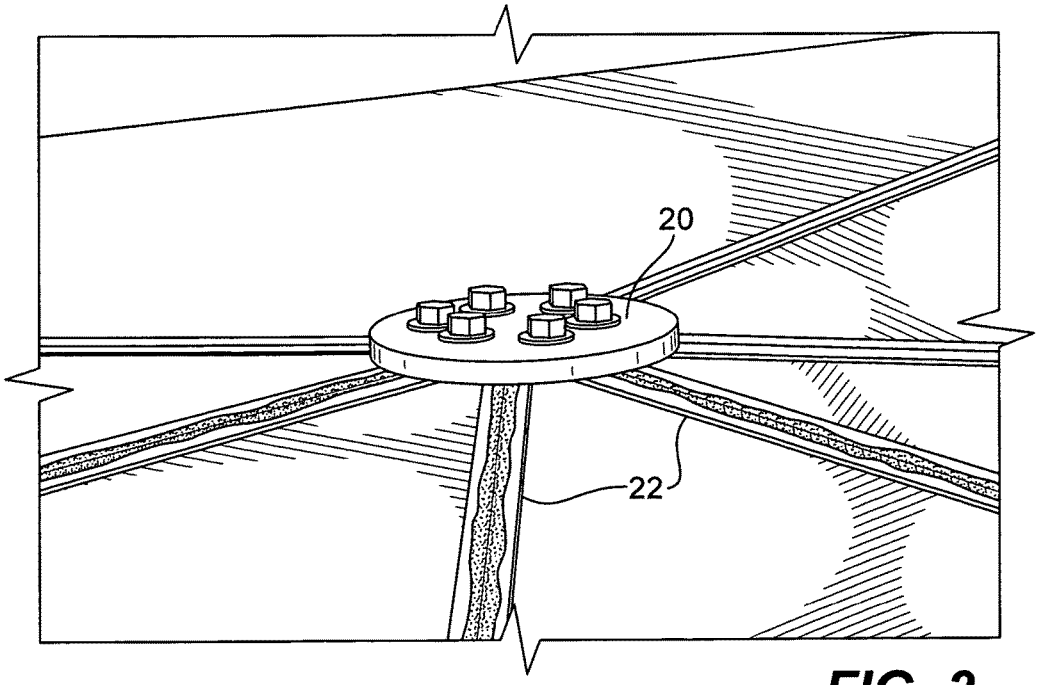
FIG. 2 shows a side view of a cluster joint with sealant and cap.

FIG. 2 shows the cap 20 and the cured silicone sealant 22.

Figure 3:
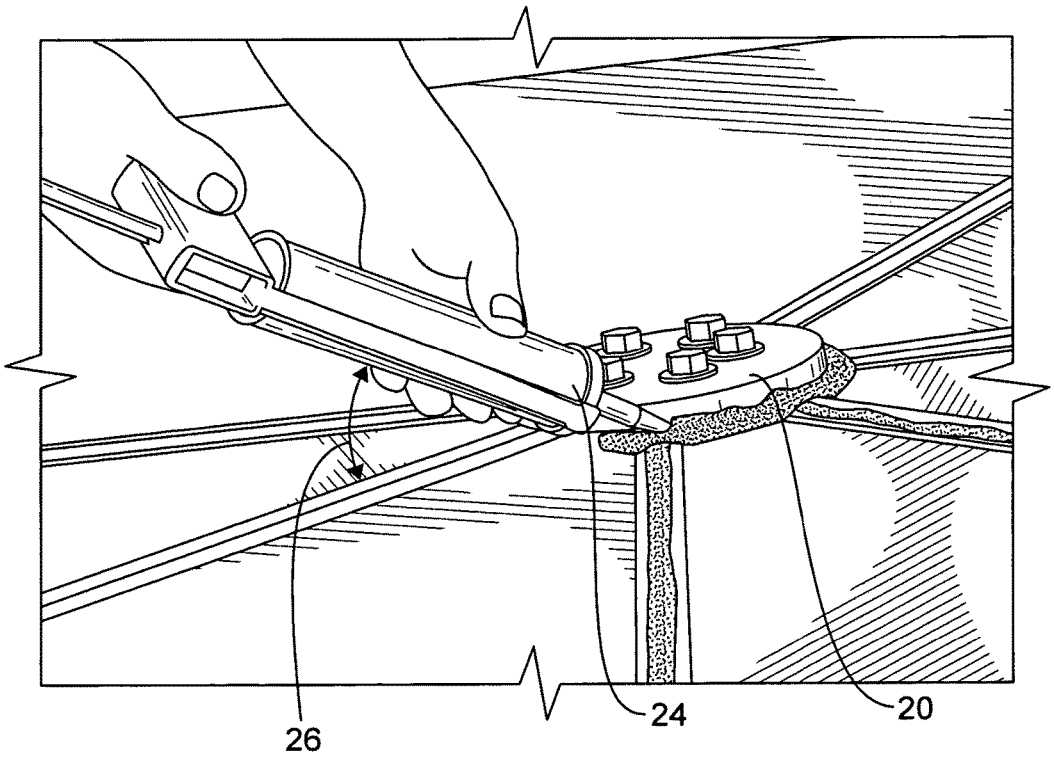
FIG. 3 Prior Art
FIG. 3 shows a top view of the prior art method for applying sealant.

FIG. 3 (Prior Art) shows the cap 20 wherein a caulking gun 24 is used to provide a sealant. Use of a caulking gun 24 does not insure sealant contact with the underside of the outer cap. Angle 26 misses the pointing of the nozzle of the gun 24 to assure sealant contact with the bottom of the cap.

Figure 4:
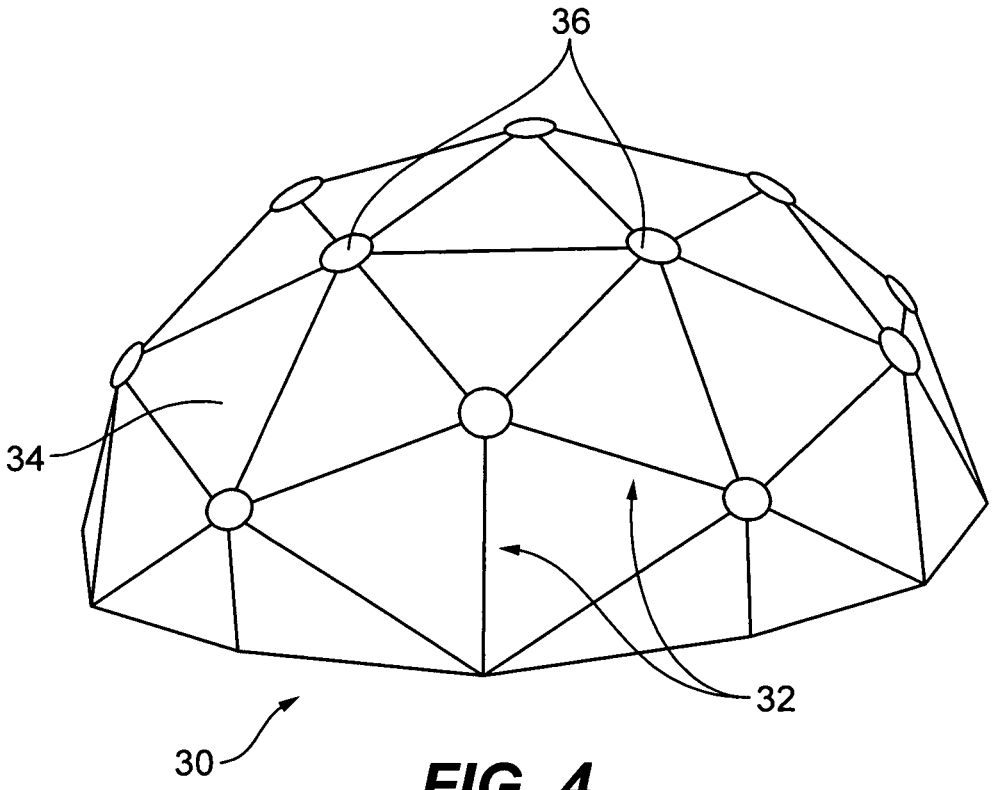
FIG. 4 is a side view of a Geodesic dome.

FIG. 4 shows a Geodesic dome 30 having aluminum frame triangles 32, a membrane skin 34 and sealed joints 36.

Figure 5:
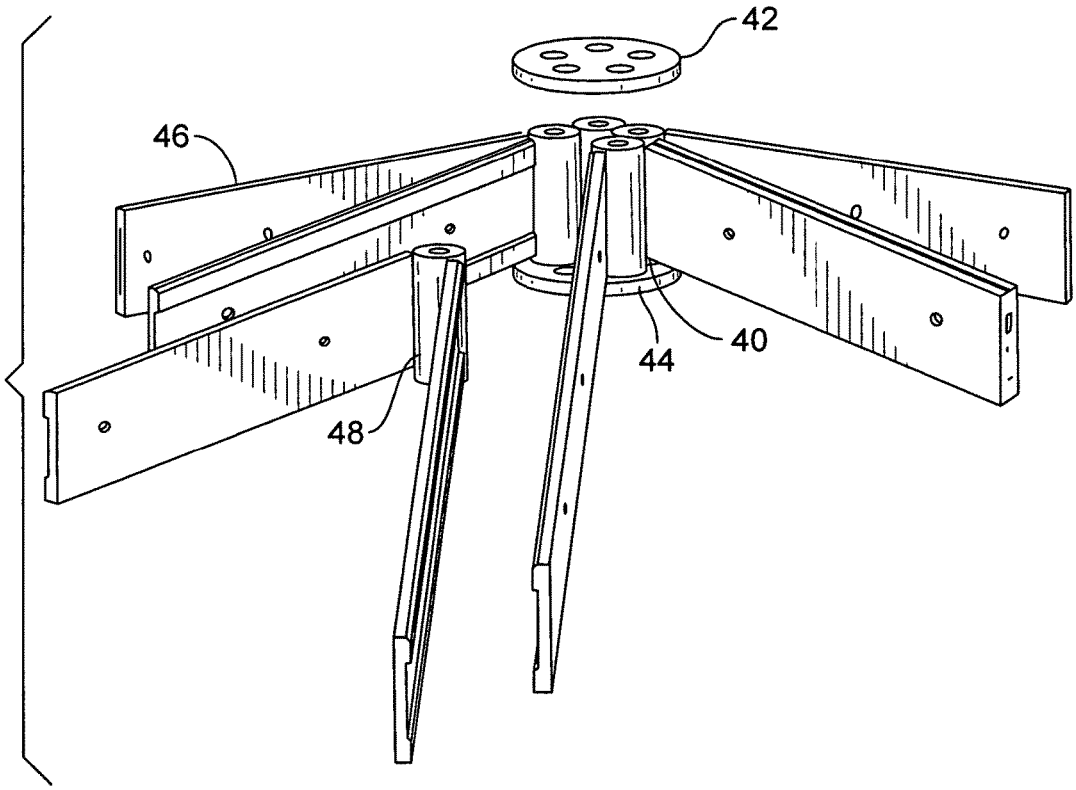
FIG. 5 is an assembly view of the cluster of the present invention.

FIG. 5 shows the assembly of the cluster of corner bosses 40, having an outer cap 42 and an inner cap 44. Aluminum frame beams 46 are attached to the corner bosses 48. Beams 46 of each triangular facet are bolted to the next facet. The inner cap 44 and the outer cap 42 are bolted to the cluster of corner bosses 40.

Figure 6:
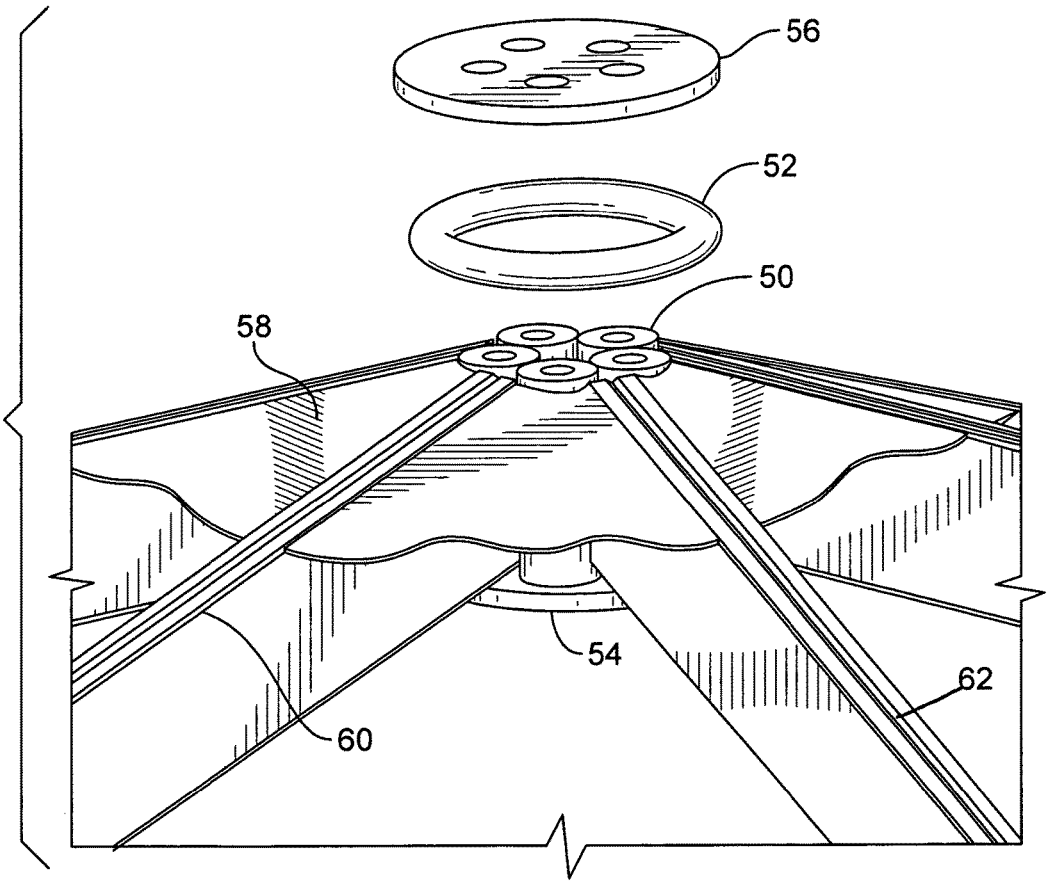
FIG. 6 is an assembly view of the cluster of the present invention having a sealant ring.

FIG. 6 shows the cluster of corner bosses 50 having a pre-dosed sealant ring 52. The cluster of corner bosses has an inner cap 54 below it, and the pre-dosed sealant ring 52 above it, with the outer cap 56 above it. The membrane 58 is cutaway in the figure. An attachment groove 60 for the membrane 58 is shown. The membrane 58 is attached to the attachment groove 60 through an epoxy bond. The groove 62 is for the silicone sealant.

Figure 7:
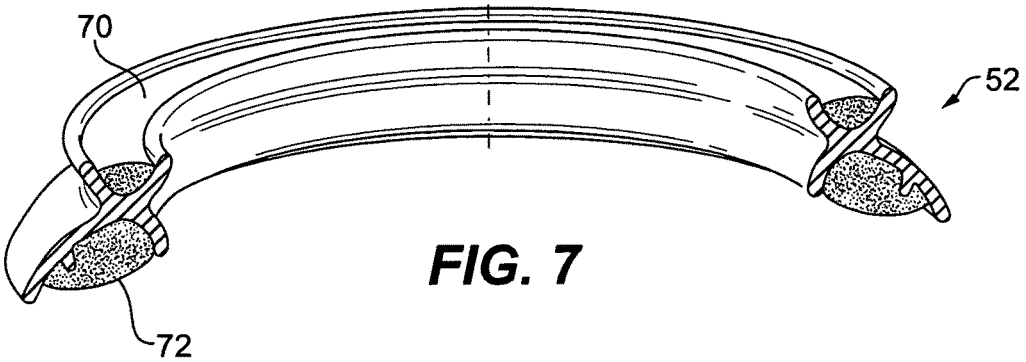
FIG. 7 shows a cross sectional view of the sealant ring.

FIG. 7 is a cross section of the sealant ring 52 having an upper sealant channel 70 pre-loaded with sealant, and a lower sealant channel 72 pre-loaded with sealant.

Figure 8:
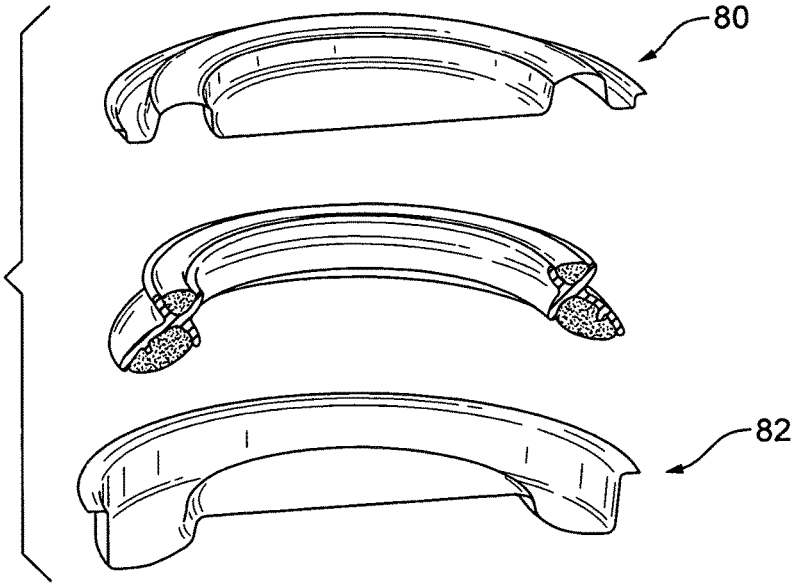
FIG. 8 shows a cross sectional view of the packaging for the sealant ring.

FIG. 8 shows the upper vacuum-formed protective plastic shell 80 and the lower vacuum-formed protective plastic shell 82 that is deployed above and below the sealant ring. In an embodiment, the shell packaging is hermetically sealed in an aluminum composite-film packaging pouch to provide extended shelf life.

Figure 9:
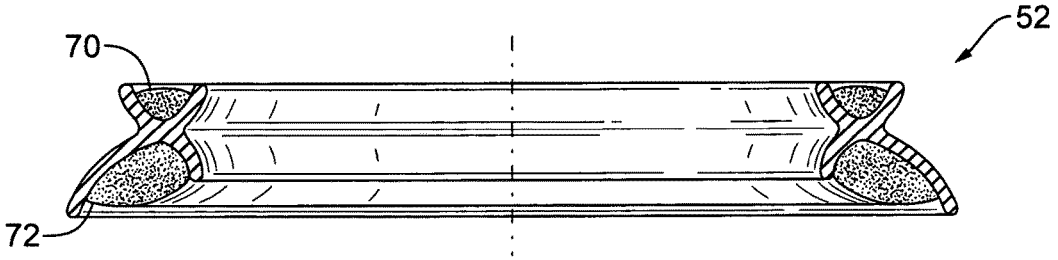
FIG. 9 shows a cross sectional view of the uncollapsed sealant ring.

FIG. 9 shows a cross section of the sealant ring 52. In an embodiment, the sealant ring 52 comprises a low durometer elastomer that collapses when the outer cap is installed, driving the pre-loaded sealant into the mating surfaces.

Figure 10:
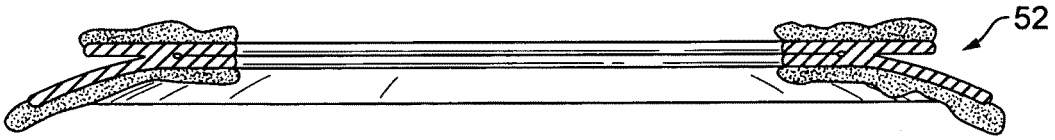
FIG. 10 shows a cross-sectional view of the collapsed sealant ring.

FIG. 10 shows the sealant ring 52 after pressure has been added, flattening the ring 52 wherein the ring becomes embedded in the gasket, forcing the lower sealant band onto the membrane skin.

Figure 11:
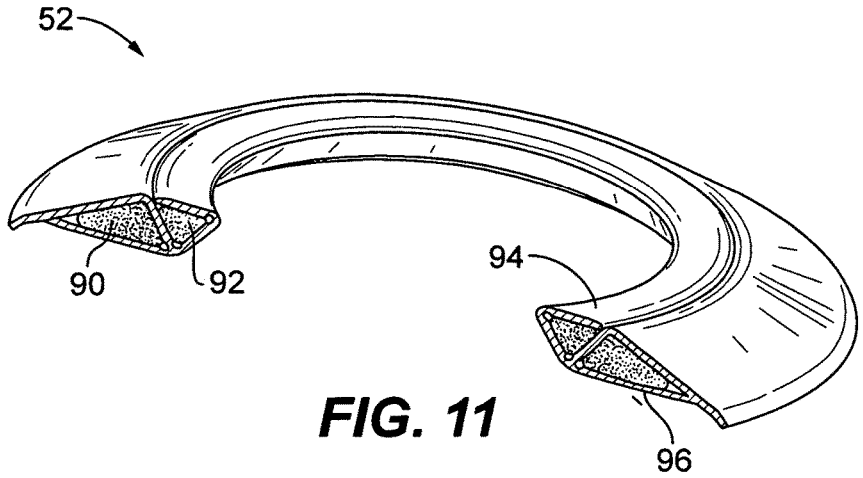
FIG. 11 shows a cross sectional view of the sealant ring.

FIG. 11 shows the sealant ring 52 having pre-loaded sealant 90 and 92. The top flap 94 and the bottom flap 96 provide nearly complete closure. The sealant expulsion package provides a high level of protection.

Figure 12:
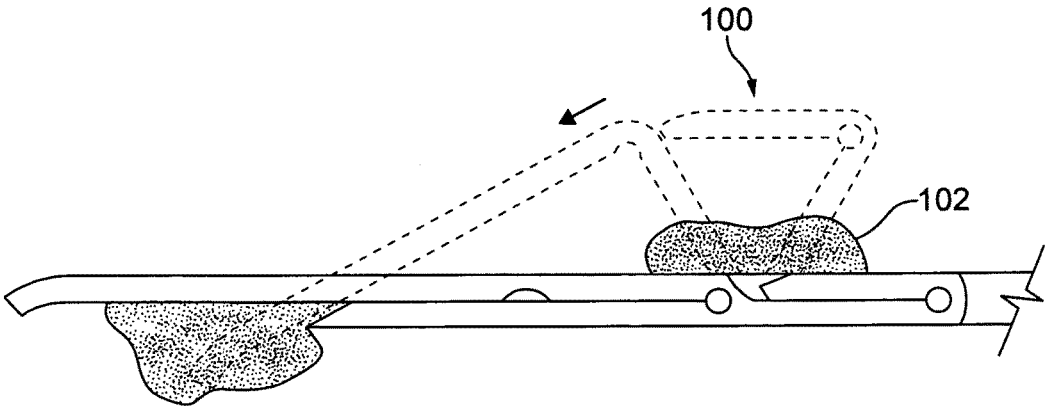
FIG. 12 shows the forces necessary to expel the sealant from the sealant ring.
Figure 13:
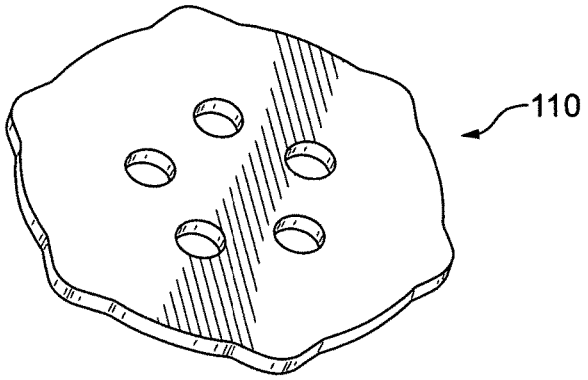
FIG. 13 shows a top view of the outer cap of the present invention.

FIG. 12 shows the method for expelling the sealant from the support channels to opposite surfaces to be sealed. Force 100 is exerted which causes the sealant 102 to be forced from the support channels FIG. 13 shows outer cap 110 that provides retaining lobes to mate with complementary features inside additional protective cap.

Figure 14:
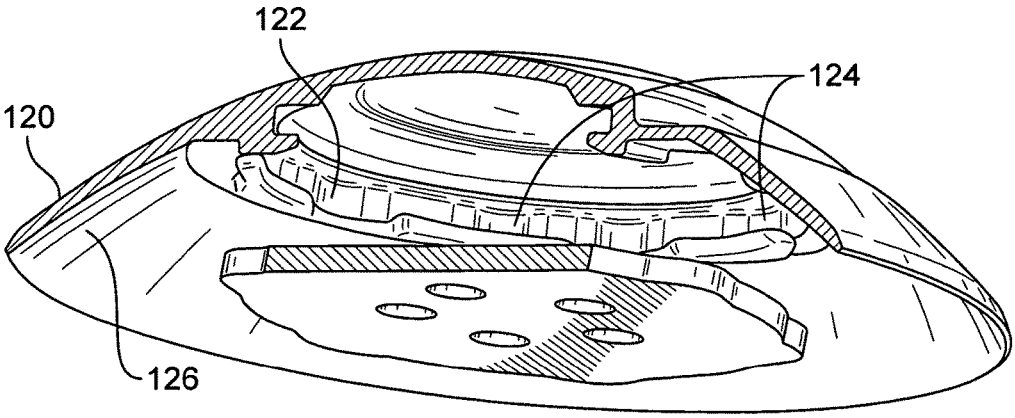
FIG. 14 shows a cross sectional view of the elastomer cap of the present invention.

FIG. 14 shows a molded elastomer cap 120 having an insertion contour 122 and retention pockets 124. The insertion contour 122 accepts the retaining lobes of outer cap 110. The cap 120 is then rotated to position the retaining lobes of outer cap 110 in the retention pockets 124 of the cap 120. The force exerted in dilating the elastomer cap 120 increases the retention of the cap 120. Zone 126 of the lip conforms to the flat facets of the membrane skin of the dome.

The invention claimed is:

1. A Geodesic dome comprising:

aluminum frame triangles, a membrane skin, and sealed joints;

a cluster of corner bosses, having an outer cap and an inner cap bolted thereto;

aluminum frame beams creating said aluminum frame triangles, said aluminum frame beams attached to said corner bosses;

said frame beams of each triangle are bolted to an adjacent triangular facet;

said cluster of corner bosses having a pre-dosed sealant ring attached;

said cluster of corner bosses having said inner cap below said cluster of corner bosses, said pre-dosed sealant ring above said cluster of corner bosses, and said outer cap above said pre-dosed sealant ring;

said membrane skin located between said aluminum frame beams attached to an attachment groove;

an additional groove for receiving silicone sealant from said sealant ring.

2. The dome of claim 1 wherein said sealant ring comprises an upper sealant channel pre-loaded with sealant, and a lower sealant channel pre-loaded with sealant.

3. The dome of claim 1 wherein said sealant ring comprises a low durometer elastomer that collapses when said outer cap is installed, driving said pre-dosed sealant into mating surfaces.

4. The dome of claim 2 wherein said sealant ring flattens after pressure has been added, forcing said sealant from said lower channel onto said membrane skin.

5. The dome of claim 1 wherein said sealant ring comprises a top flap and bottom flap providing nearly complete closure of said pre-dosed sealant.

6. The dome of claim 1 wherein said outer cap comprises retaining lobes.

7. The dome of claim 1 further comprising a molded elastomer cap having an insertion contours, retention pockets, and a zone that conforms to flat facets of said membrane skin of said dome.

8. The dome of claim 7 wherein said insertion contours of said molded elastomer cap accept retaining lobes of said outer cap;

said molded elastomer cap is rotated to position said retaining lobes of said outer cap in said retention pockets of said molded elastomer cap.

9. The dome of claim 8 wherein said rotational force exerted on said elastomer cap increases retention of said elastomer cap.

* * * * *